US006647225B2

(12) United States Patent
Kakeshita

(10) Patent No.: US 6,647,225 B2
(45) Date of Patent: Nov. 11, 2003

(54) CHARGING DEVICE FOR FRICTIONALLY-CHARGING AN IMAGE BEARING MEMBER AND IMAGE FORMING APPARATUS INCLUDING SAME

(75) Inventor: Tomomi Kakeshita, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/091,508

(22) Filed: Mar. 7, 2002

(65) Prior Publication Data

US 2003/0063919 A1 Apr. 3, 2003

(30) Foreign Application Priority Data

Mar. 13, 2001 (JP) ..... 2001-069675

(51) Int. Cl.[7] ..... G03G 15/02; G03G 21/00
(52) U.S. Cl. ..... 399/100; 399/150; 399/176
(58) Field of Search ..... 399/100, 174, 399/176, 127, 128, 129, 149, 150

(56) References Cited

U.S. PATENT DOCUMENTS 5,465,136 A 11/1995 Watanabe ..... 355/210
5,754,926 A 5/1998 Sakuraba et al. ..... 399/175
6,314,257 B1 11/2001 Ishii et al. ..... 399/150
6,341,207 B1 * 1/2002 Sasaki et al. ..... 399/149
6,496,663 B2 * 12/2002 Shimizu et al. ..... 399/176

FOREIGN PATENT DOCUMENTS

JP 11-311916 A * 11/1999
JP 2000-181200 A * 6/2000
JP 2001-201981 A * 7/2001

* cited by examiner

*Primary Examiner*—Joan Pendegrass
(74) *Attorney, Agent, or Firm*—Fitzpatrick, Cella, Harper & Scinto

(57) ABSTRACT

A charging device includes a charging rotary member provided in contact with an image bearing member capable of bearing a toner for charging the image bearing member, in which a peripheral speed of the charging rotary member is different from a peripheral speed of the image bearing member, and the charging rotary member includes a surface layer frictionally charging the toner to a normal charging polarity.

25 Claims, 6 Drawing Sheets

CHARGING DEVICE FOR FRICTIONALLY-CHARGING AN IMAGE BEARING MEMBER AND IMAGE FORMING APPARATUS INCLUDING SAME

BACKGROUND OF THE INVENTION

1. Field of the Invention

The present invention relates to a charging device, which charges an image bearing member such as a photosensitive member and a dielectric member, and to an image forming apparatus such as a laser beam printer and a copying machine, to which the charging device is applied.

2. Description of Related Art

Conventionally, in an image forming apparatus such as a copying machine and a laser beam printer using an electrophotographic process, an image is formed by a series of image forming processes in general. The image forming process comprises a charging process, a latent image forming process, a developing process, a transfer process, a fixing process and a cleaning process. More specifically, in the charging process, the image bearing member such as a photosensitive drum and a dielectric member is charged evenly and uniformly, and in the latent image forming process, an electrostatic latent image is written into the image bearing member after being charged. Further, in the developing process, a toner is attracted to the electrostatic latent image so that the latent image is developed as a toner image, and in the transfer process, the toner image on the image bearing member is transferred to a transfer material such as a sheet of paper and the like. Further, in the fixing process, the toner image on the transfer material is fixed, and in the cleaning process, a residual matter such as a transfer residual toner remaining on the surface of the image bearing member after the toner image is transferred is removed.

In the above cleaning process, the transfer residual toner collected by a cleaning device is contained in a disposable container, and thereafter, has been discarded. Moreover, in recent years, a cleaner-less process has been proposed in which a cleaning device is omitted in order to miniaturize an image forming apparatus, and maintenance required for discarding a transfer residual toner is dispensable. According to one embodiment of the cleaner-less process, a developing device attracts a toner to a portion of the image bearing member in which a surface potential decays by exposure by reversal development while collecting a residual matter remaining on a non-exposure portion. More specifically, after the transfer process, the residual matter passes through the charging process, and thereafter, is collected to the developing device by an electrostatic force generated by the difference (hereinafter, referred to as "back contrast") between a surface potential of the image bearing member and a developing bias applied to a development roller.

According to the above-mentioned type charging device, in the transfer process, a residual matter on the positively charged image bearing member and a reversal toner remaining in a non-image section are attracted to a charging roller used as a charging rotary member; for this reason, a charging performance of the charging roller is reduced. Moreover, in the image forming apparatus using the cleaning device, a toner passing through the cleaning device is attracted to the charging roller; as a result, a charging performance of the charging roller is reduced, although it is not so conspicuous as the cleaner-less type.

Conventionally, in order to prevent the reduction of a charging performance, various types have been proposed, such as:

a type of providing a collecting member for temporarily collecting a reversal toner or the like upstream of the charging roller;

a type of abutting a cleaner member against the charging roller; and a type of collecting a toner onto the image bearing member by mechanical rubbing in a state that a peripheral speed is given to the charging roller.

However, in the above types, that is, the type of providing a collecting member for temporarily collecting a reversal toner or the like upstream of the charging roller and the type of abutting a cleaner member against the charging roller, there is the following problem. More specifically, another member is required; for this reason, the cost increases. In addition, the effect cannot be sufficiently obtained when the reversal toner is accumulated in the collecting member and the cleaner member.

Moreover, in the above type of giving a peripheral speed different from the image bearing member to the charging roller, there is the following problem. That is, although the toner may be returned by the above mechanical rubbing, under an electric field condition applied to one direction such as DC charging, the toner, which is not collected to the image bearing member by only mechanical rubbing, is attracted to the charging roller depending on environment and the using condition of printer. When the toner is attracted to the charging roller, a resistance of the charging roller becomes locally high; for this reason, an excessive discharge occurs when contamination is little, and further, when the contamination exceeds a predetermined value, a charging failure occurs. As a result, a charging potential on the image bearing member falls into disorder as shown in the following Table 1, and thus, image uniformity can not be obtained by the above disorder of the charging potential. Moreover, under the condition of high temperature and high humidity, the toner is not likely to retain a charge; for this reason, this is a factor of increasing an extraneous amount onto the cleaning roller of the reversal toner and the residual matter on the image bearing member. As a result, the charging performance is reduced in the print endurance latter by half, and thus, image failure occurs.

TABLE 1

| Contamination amount of charging roller ($mg/cm^2$) | Charging potential on image bearing member (−V) | Image |
|---|---|---|
| 0 | 700 | ○ |
| 0.05 | 720 | Δ |
| 0.2 | 650 | × |

○: good, Δ: normal, ×: bad

SUMMARY OF THE INVENTION

The present invention has been made in view of the above problems. Accordingly, an object of the present invention is to provide a charging device and an image forming apparatus, which can prevent toner contamination of a charging rotary member.

Another object of the present invention is to provide a charging device and an image forming apparatus, which can obtain a charging potential stable as a surface potential of an image bearing member.

Another object of the present invention is to provide a cleaner-less type image forming apparatus having no dedicated cleaner, and a charging device used for the image forming apparatus.

Another object of the present invention is to provide a charging device and an image forming apparatus, which can frictionally charge a toner to a normal polarity by a charging rotary member.

BRIEF DESCRIPTION OF THE DRAWINGS

The above and further objects and features of the present invention will become more fully apparent from the following detailed description with reference to the accompanying drawings in which.

DESCRIPTION OF THE PREFERRED EMBODIMENTS

Hereinafter, the preferred embodiments of the present invention will be described with reference to the accompanying drawings.

<First Embodiment>

Figure 1:
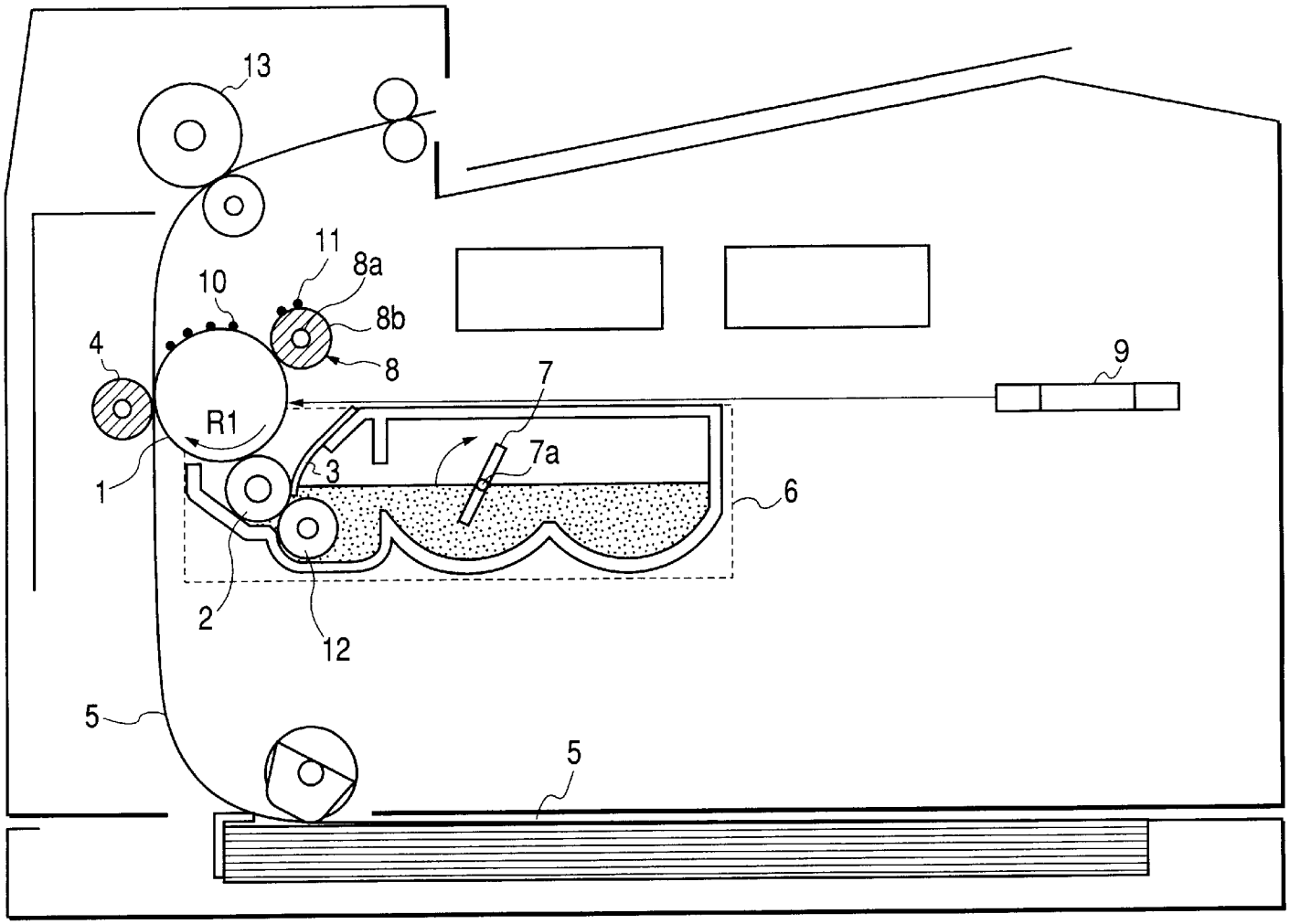
FIG. 1 is a vertically sectional view showing an image forming apparatus (laser beam printer) according to a first embodiment of the present invention.

FIG. 1 is a vertically sectional view schematically showing a structure of a laser beam printer using an electrophotographic process given as one example of the image forming apparatus according to the present invention.

The laser beam printer shown in FIG. 1 includes a drum-shaped electrophotographic photosensitive member (hereinafter, referred to as "photosensitive drum") 1 as a member to be charged (an image bearing member). A charging roller (charging device) 8 as a charging rotary member, an exposure device 9, a developing device 6 and a transfer roller (transfer device) 4 are arranged around the photosensitive drum 1 substantially in succession along a rotating direction (a direction indicated by an arrow R1 of FIG. 1) of the photosensitive drum 1.

The photosensitive drum 1 is constructed in a manner that a cylindrical drum base surface having conductivity is formed with a photoconductive layer (e.g., OPC (organic photoconductor), amorphous silicon, etc.). Further, the photosensitive drum 1 is rotatably driven by driving means (not shown), and its surface is moved (rotated) in the direction indicated by the arrow R1 at a predetermined surface movement speed (hereinafter, referred to as "peripheral speed").

The charging roller 8 is constructed in a manner that an outer peripheral surface of a core metal 8*a* is covered with an elastic member 8*b*. The surface of the elastic member 8*b* is arranged so as to contact with the surface of the photosensitive drum 1, and a direct current voltage of −1,250 V is applied to the core metal 8*a* by a charging power source (not shown). By doing so, the surface of the photosensitive drum 1 is charged so as to have a charging potential (dark section potential) of −700 V. More specifically, a voltage larger than a discharge start voltage such that a discharge starts between the charging roller 8 and the photosensitive drum 1 is applied to the charging roller 8, and thereby the photosensitive drum 1 is charged by the charging roller 8 using the electric discharge.

The exposure device 9 includes a laser oscillator, a polygonal mirror, a lens and the like, which are not shown, and irradiates a laser beam generated in accordance with image information to the surface of the photosensitive drum 1, and thereby a potential (bright section potential) of the laser beam irradiated portion becomes a voltage of −120 V.

The developing device 6 is provided with a rotatably driven developing roller 2, a developing blade 3, a toner supply roller 12 for applying the toner onto the developing roller 2 and an agitating member 7. More specifically, the developing blade 3 regulates a layer thickness of a toner, which is a developer borne on the surface of the developing roller 2, and the agitating member 7 rotates about a shaft 7*a* in a direction indicated by the arrow so as to agitate the toner while supplying the toner toward the developing roller 2. In this case, either magnetic or non-magnetic toner may be used as the developer, and either polymerization or pulverization may be employed as the method of preparing the developer. In the first embodiment, a toner charged to a minus polarity by friction is used. That is, in the first embodiment, a normal polarity of the toner is a minus. The toner is applied onto the surface of the developing roller 2, and has a layer thickness regulated by the developing blade 3. Further, when applying a developing bias of −400 V to the developing roller 2 by a power source (not shown), the toner is attracted to a bright section of the photosensitive drum 1, and thereby, an electrostatic latent image is reversal-developed as a toner image.

A transfer bias having a plus polarity reverse to the toner on the photosensitive drum 1 is applied to the transfer roller 4 by a power source (not shown). As a result, a toner image is transferred on the surface of a transfer material 5 such as paper conveyed between the transfer roller 4 and the photosensitive drum 1 at a predetermined timing. Then, the transfer material 5 onto which the toner image is transferred is heated and pressed by a fixing device 13, and thereafter, is discharged outside the apparatus after the toner image is fixed on the surface of the transfer material.

On the other hand, after the toner image transfer, a transfer residual toner remaining on the surface of the photosensitive drum 1, that is, a residual matter 10 on the photosensitive drum 10 is removed in the following manner.

More specifically, in the developing process, the toner attracted to the surface of the photosensitive drum 1 from the developing device 6 is charged to a minus polarity. When the back surface of the transfer material 5 is positively charged by the transfer roller 4 in the transfer process, the toner is transferred on the transfer material 5 by its electric field. In this case, the photosensitive drum 1 is positively charged likewise; for this reason, part of the toner is changed to a plus polarity. As a result, the toner is not fully transferred onto the transfer material 5, and thus a part of toner remains on the photosensitive drum 1. Therefore, the residual matter 10 on the photosensitive drum 1, which is not transferred onto the transfer material 5 and remains on the surface of the photosensitive drum 1, is charged to both plus and minus polarities. The negatively charged residual matter is collected in development. More specifically, the photosensitive drum 1 is charged by the charging roller 8 even if a residual toner exists, and then an electrostatic latent image is formed by the laser beam. By doing so, the toner can be attracted to the bright section of the electrostatic latent image from the developing roller 2 to which the developing bias is applied, while the toner can be collected from a dark section of the electrostatic latent image to the developing roller 2.

However, in order to collect the residual matter 10 on the photosensitive drum charged to a plus polarity by the back contrast in the developing process, the residual matter 10 on the photosensitive drum needs to be charged to a minus polarity. This is carried out at the same time when the surface of the photosensitive drum 1 is charged to a minus polarity by the charging roller 8. In the manner as described above, the residual matter 10 on the photosensitive drum 1 is collected to the developing device 6.

In this case, however, part of the residual matter 10 on the photosensitive drum is charged to a minus polarity; on the contrary, other parts thereof is attracted to the surface of the charging roller 8 before being charged to a minus polarity. As a result, the residual matter 10 remains as a contamination matter 11 on the charging roller. The contamination matter 11 on the charging roller hinders preferable charging of the photosensitive drum 1 by the charging roller 8 in charging.

In the first embodiment, the contamination matters 11 on the charging roller are removed in the following manner.

More specifically, the surface of the charging roller 8 is brought into contact with the surface of the photosensitive drum 1 rotating at a predetermined peripheral speed. By doing so, the charging roller 8 is rotated in a forward direction so that the peripheral speed is different between the charging roller 8 and the photosensitive drum 1, or the charging roller 8 is rotated in a backward direction. In this case, the forward direction means the case where the rotating direction of the charging roller 8 and that of the photosensitive drum 1 are the same at a contact position of the charging roller 8 and the photosensitive drum 1. On the other hand, the backward direction means the case where the roller rotating direction and the drum rotating direction are reverse to each other at the contact portion. In the first embodiment, the charging roller 8 is rotated at a 120% peripheral speed with respect to the photosensitive drum 1. By doing so, a peripheral speed difference is generated between the surface of the photosensitive drum 1 and the surface of the charging roller 8, and further, the contamination matter 11 on the charging roller remaining on the surface of the charging roller 8 is rubbed against the photosensitive drum, and thereafter is charged to a minus polarity by frictional charging. Moreover, the charging roller 8 is quickly rotated in the forward direction with respect to the photosensitive drum 1, and thereby the toner is easy to pass through the contact position of the charging roller 8 and the photosensitive drum 1; therefore, the toner attracted onto the charging roller 8 is readily returned to the photosensitive drum 1. In this case, the minus-charged toner is shifted in some degree to the surface of the photosensitive drum 1 by a potential difference (charging roller 8: −1,250 V, photosensitive drum 1: −700 V) between the charging roller 8 and the photosensitive drum 1.

Figure 2:
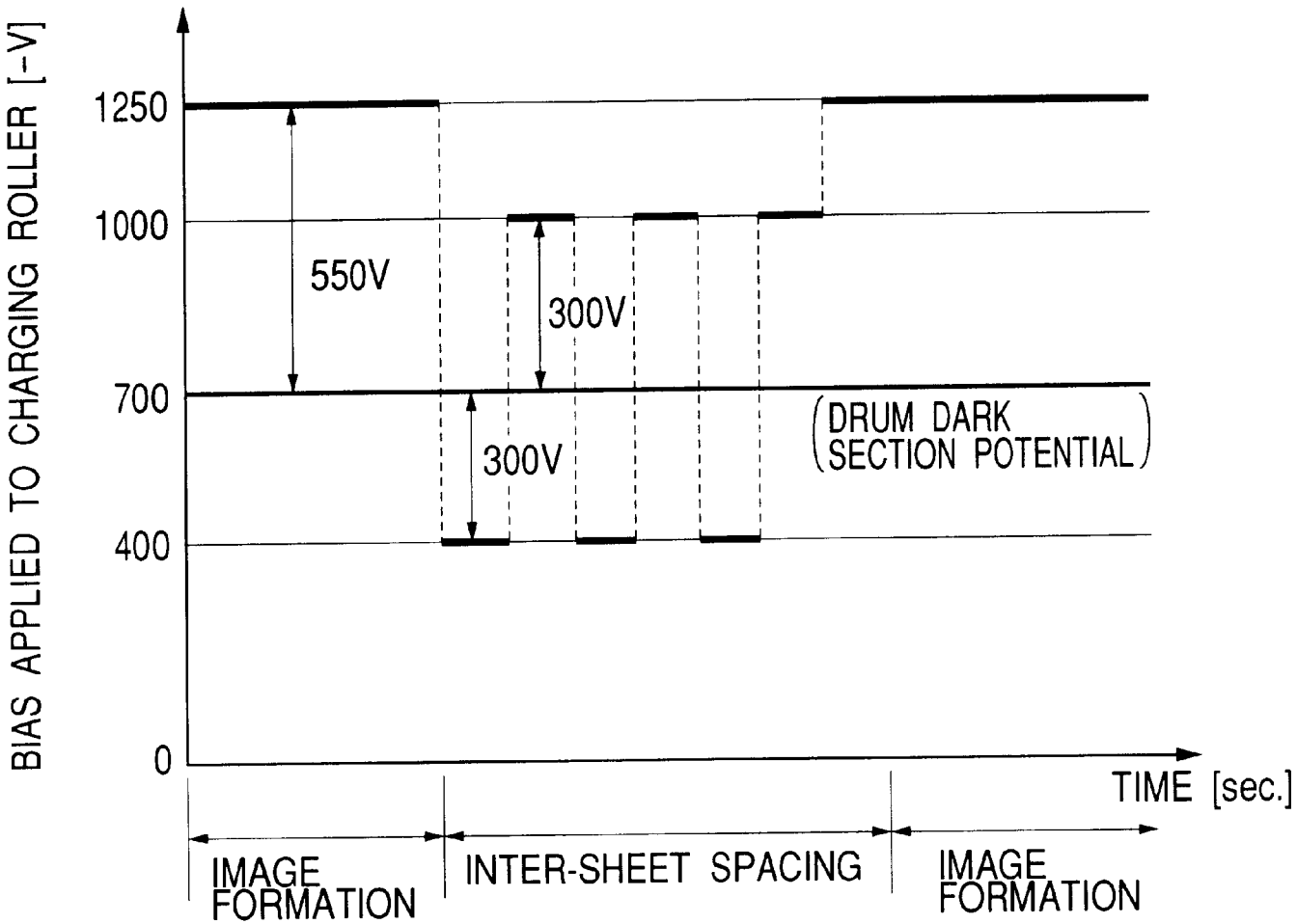
FIG. 2 is a cleaning sequence chart in the image forming apparatus according to the first embodiment of the present invention.

However, some of the toners are not all charged to a minus polarity. Thus, it is preferable that a bias as shown in FIG. 2 be applied in a non-image region to thereby move the contamination matter 11 on the charging roller, which is not moved by only one-directional electric field, from the surface of the charging roller 8 to the surface of the photosensitive drum 1 (to collect the contamination matter 11 on the charging roller to the photosensitive drum 1 ).

Now a description will be made of a surface layer of the charging roller 8.

In the first embodiment, the peripheral speed difference is given between the charging roller 8 and the photosensitive drum 1, and thereby frictional charging is given to the toner on the charging roller 8. For this reason, a collecting performance to the photosensitive drum 1 becomes greatly different depending on the polarity of the surface layer of the charging roller 8 and the polarity of the toner.

Figure 3:
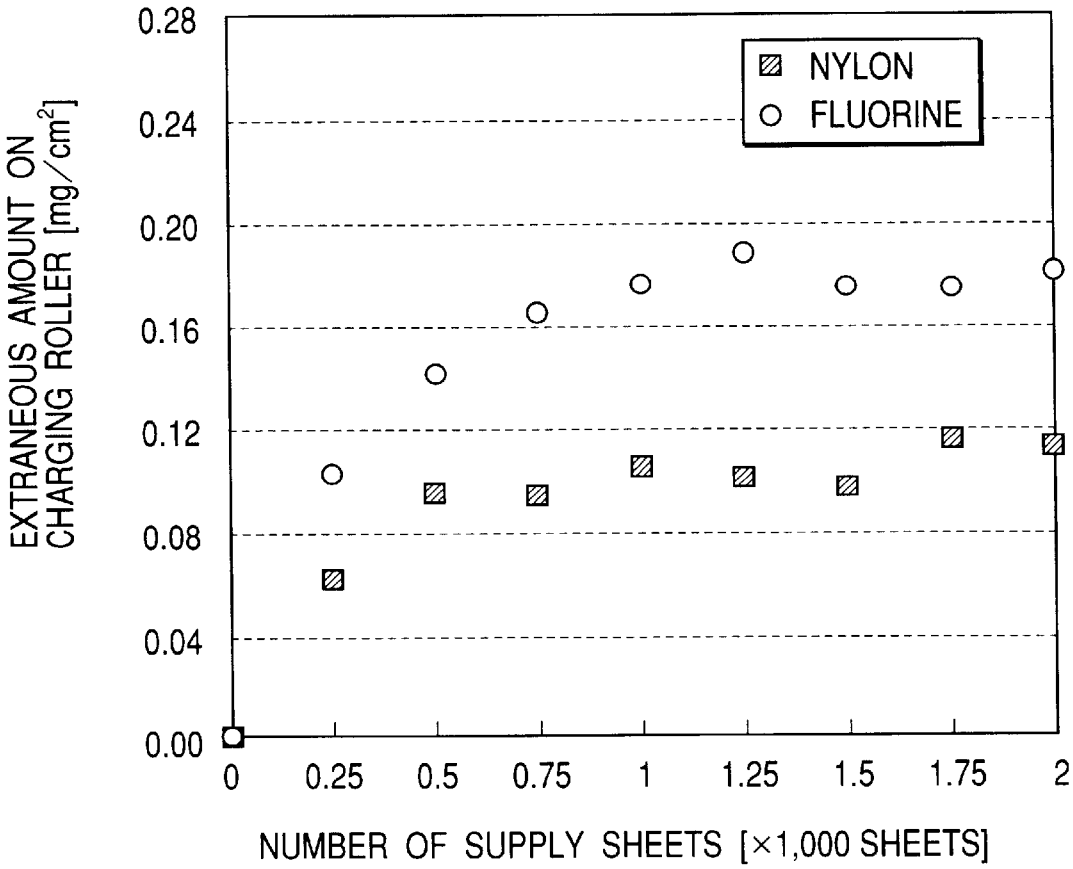
FIG. 3 is a graph showing a relation between a difference in a surface layer of a charging roller and an extraneous amount on the charging roller in the image forming apparatus according to the first embodiment of the present invention.

FIG. 3 shows an extraneous amount on the charging roller with respect to the difference in a surface layer of the charging roller.

In the first embodiment, a negative toner using styrene acryl as a main component is used as the toner. Therefore, as seen from FIG. 3, a nylon-based resin surface layer, which is closer to a plus side than the toner quality, makes the toner more negative in the charging system, so that the extraneous amount on the charging roller can be reduced.

Figure 4:
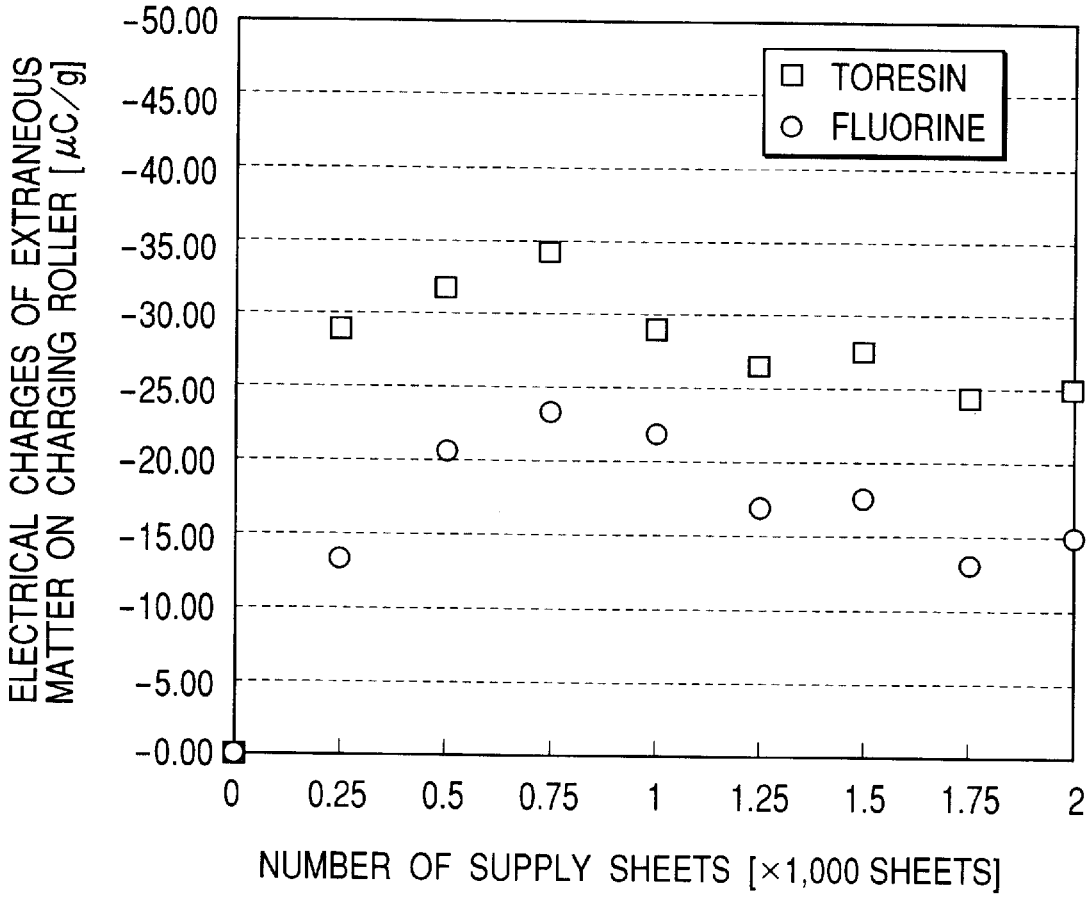
FIG. 4 is a graph showing a relation between a difference in a surface layer of the charging roller and an amount of electrical charge of an extraneous matter on the charging roller in the image forming apparatus according to the first embodiment of the present invention.

Moreover, as seen from an amount of electrical charge of the extraneous matter on the charging roller shown in FIG. 4, the nylon-based resin surface layer makes the toner on the charging roller a minus polarity (normal polarity of the toner) as compared with the case of a fluorine-based resin surface layer.

Based on the above results, in the first embodiment, the nylon-based surface layer serves to readily make more negative the contamination matter 11 on the charging roller and to readily collect it on the photosensitive drum 1; therefore, the charging roller 8 having the nylon-based surface layer has been used. Incidentally, in the first embodiment, methyl methoxylation 6-nylon ("Toresin" produced by Teikoku Kagaku Sangyo Kabushiki Kaisha) is used as the nylon-based surface layer material, and a resin containing polytetrafluoroethylene is used as the fluorine-based resin surface layer material.

Subsequently, a cleaning sequence in a non-image region of the photosensitive drum 1 will be described below with reference to FIG. 2.

Preferably, the cleaning sequence (sequence for returning the toner from the charging roller 8 to the photosensitive drum 1) is inserted every predetermined number of sheets with respect to the number of print sheets. In the first embodiment, the cleaning sequence is inserted every five print sheets, immediately after an image formation signal is inputted, and after an image formation completion signal is inputted. In the cleaning sequence, a voltage, which periodically changes plus and minus seemingly, is applied to the potential of the photosensitive drum 1, and thereby a bi-directional electric field (alternate electric field) is given between the charging roller 8 and the photosensitive drum 1. By doing so, the contamination matter 11 on the charging roller charged by the peripheral speed difference is moved onto the photosensitive drum 1. More specifically, an applying bias to the charging roller 8 is switched between −1,000 V and −400 V with respect to the surface potential −700 V of the photosensitive drum 1 (i.e., applying bias is formed into a rectangular waveform shape), and thereby the potential difference of 300 V is given between both plus and minus polarities.

Figure 5:
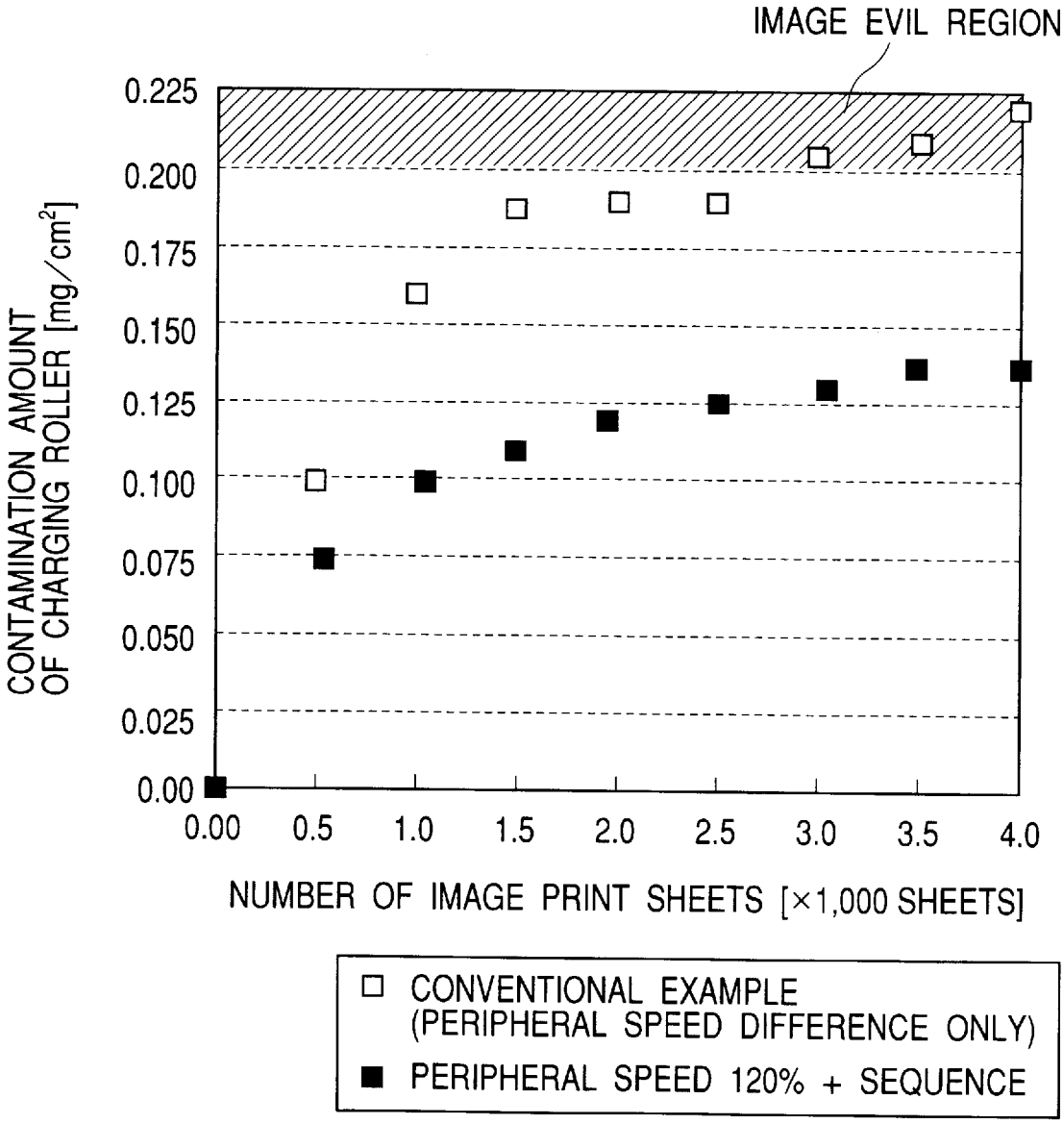
FIG. 5 is a graph showing a sequence effect of the extraneous matter on the charging roller in the image forming apparatus according to the first embodiment of the present invention.

FIG. 5 shows a contamination amount on a charging roller in a conventional example and the present invention.

As is evident from FIG. 5, in the conventional example giving the peripheral speed difference to the charging roller, the contamination matter on the charging roller is not collected onto the photosensitive drum, and is attracted to the charging roller. For this reason, the contamination matter on the charging roller increases with an increase of the number of image print sheets, with the result that an image defect, that is, a leak of charging uniformity, or charging failure occurs.

On the contrary, according to the present invention giving the peripheral speed difference to the charging roller and moving the contamination matter onto the photosensitive drum by the cleaning sequence, as shown in FIG. 5, almost no contamination matter on the charging roller exists on the charging roller; therefore, a preferable image can be obtained.

In fact, after the transfer process, the residual matter 10 on the photosensitive drum equivalent to one revolution of the photosensitive drum 1 covering the surface of the photosensitive drum 1 has a density of 0.1 mg/cm$^2$ or less. On the other hand, the contamination matter 11 on the charging roller moved from the charging roller 8 to the photosensitive drum 1 has a density of 0.07 mg/cm$^2$ or less. On the contrary, the laser beam of the exposure device 9 needs to have a spot diameter of 75 to 90 $\mu$m in order to realize a toner image resolution of 600 dpi (dot/inch). According to an experiment, there was no generation of image disorder resulting from light shielding by the residual matter 10 on the photosensitive drum and the contamination matter 11 on the charging roller if the following condition is satisfied. That is, the condition is that the sum of the density of the residual matter 10 on the photosensitive drum equivalent to one revolution of the photosensitive drum 1 and the contamination matter 11 on the charging roller moved onto the photosensitive drum 1 is 0.2 mg/cm$^2$ or less.

After exposure, the residual matter 10 on the photosensitive drum and the contamination matter 11 on the charging roller each having a minus polarity are electrostatically shifted from the surface of the photosensitive drum 1 to the surface of the developing roller 2 by the back contrast 300 V (i.e., difference between a dark section potential −700 V of the photosensitive drum 1 and developing bias −400 V applied to the developing roller 2). Thereafter, these residual matter 10 and contamination matter 11 are collected in the developing device 6. The residual matter 10 on the photosensitive drum and the contamination matter 11 on the charging roller, which are collected by the developing roller 2, are agitated by the agitating member 7, and thereafter are reused in a state of being mixed with other toner.

As described above, in the first embodiment, the contamination matter 11 on the charging roller is shifted from the surface of the photosensitive drum 1 to the surface of the charging roller 8. Further, the different peripheral speed is given between the surface of the photosensitive drum 1 and the surface of the charging roller 8 so that a charge is given by frictional charging by rubbing. By doing so, the contamination matter 11 on the charging roller is charged to a minus polarity. Moreover, in electric non-image formation by the cleaning sequence, the contamination matter 11 on the charging roller is shifted to the photosensitive drum 1 by the following potential differences. That is, one is the potential difference −300 V between the charging roller bias −1,000 V and the surface potential −700 V of the photosensitive drum 1, and another is the potential difference +300 V between the charging roller bias −400 V and the surface potential −700 V of the photosensitive drum 1. Therefore, the contamination matter 11 on the charging roller on the surface of the charging roller 8 is removed without providing new members or a high-voltage power source in the image forming apparatus. As a result, it is possible to carry out preferable charging, and to obtain a charging potential, which is stable as the surface potential of the surface of the photosensitive drum 1.

According to the experiment, the present inventors have found the following fact; that is, it is effective to give 1% or more peripheral speed difference between the photosensitive drum and the charging roller. Therefore, preferably, the above-mentioned peripheral speed difference has 1% or more difference in the peripheral speed.

Further, in the first embodiment, the cleaning sequence is inserted into a region, that is, an inter-sheet spacing region of the photosensitive drum 1 every predetermined number of sheets. In this case, the cleaning sequence may be inserted every print sheet, that is, inter-sheet spacing. Further, during the cleaning sequence, the switchover of plus and minus voltages is made three times. In this case, the changeover may be made one, two or three times or more in accordance with the degree of cleaning.

Further, during the cleaning sequence, the peak-to-peak value of bias may be set larger or smaller as the need arises. However, in this case, when the potential difference between the bias and the photosensitive drum becomes the electric discharge start voltage or more, the polarity of the extraneous matter changes by the discharge; as a result, there is a tendency for the cleaning effect to reduce. For this reason, it is desirable that the potential difference between the charging roller and the photosensitive drum is set to equal or less than the electric discharge start voltage during the cleaning sequence. In the first embodiment, the present invention has been applied to a cleaner-less type image forming apparatus, which can remarkably show the effect of the present invention. In this case, the same effect as above can be obtained even if the present invention is applied to an image forming apparatus including a cleaning device such as a cleaning blade and the like.

<Second embodiment>

Next, a description will be made of a second embodiment of the present invention.

The configuration of the image forming apparatus (laser beam printer) according to the second embodiment and the cleaning sequence are the same as the above first embodiment; therefore, the details are omitted, and only constituent features of the second embodiment will be described below.

Figure 6:
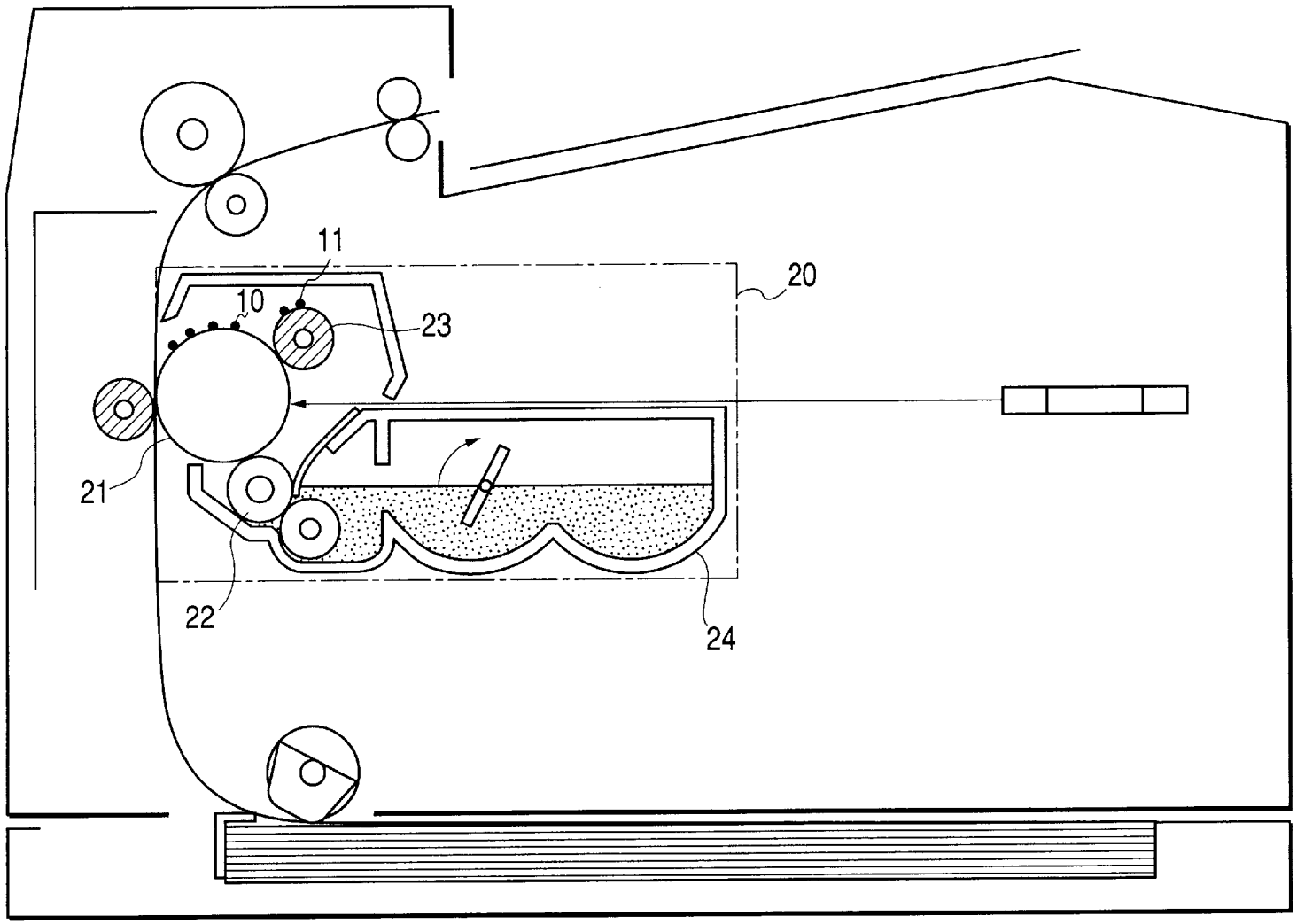
FIG. 6 is a vertically sectional view showing an image forming apparatus (laser beam printer) according to a second embodiment of the present invention.

As shown in FIG. 6, the image forming apparatus according to the second embodiment is provided with a process cartridge 20, which is detachably mountable to the apparatus main body. The process cartridge 20 is constructed as a unit integrally containing a photosensitive drum 21, a charging roller 23, a developing roller 22 and a toner container 24.

When the image forming apparatus is operated, a peripheral speed difference is provided between the surface of the photosensitive drum 21 and the surface of the charging roller 23 by a gear train (not shown) provided in the process cartridge 20, and thereby the contamination matter 11 on the surface of the charging roller 23 is rubbed. By doing so, the contamination matter 11 on the charging roller is charged to a minus polarity by frictional charging. Incidentally, in the second embodiment, the same members as the above first embodiment are used.

Therefore, also in the second embodiment, the same effect as the first embodiment can be obtained.

In the second embodiment, the present invention has been applied to a cleaner-less type image forming apparatus, which can remarkably show the effect of the present invention. In this case, the same effect as above can be obtained when the present invention is applied to an image forming apparatus including a cleaning device such as a cleaning blade and the like.

As is evident from the above description, according to the second embodiment, the charging rotary member is rotatably driven at a surface movement speed different from a surface movement speed of the image bearing member. Further, a predetermined bias and a bias changing at a predetermined cycle are applied to the charging rotary member at different timing, and thereby the developer attracted to the charging rotary member is frictionally charged. Further, in non-image formation time, the bias changing at a predetermined cycle is applied to the charging rotary member, and thereby the frictionally charged developer on the charging rotary member is electrostatically shifted to the image bearing member. Accordingly, it is possible to prevent contamination due to the developer of the charging rotary member, and to obtain a charging potential stable as the surface potential of the image bearing member.

In this case, a photosensitive belt in place of the photosensitive drum may also be used as the image bearing member, and further, a dielectric member may also be used.

A rotatable charging belt in place of the charging roller may also be used as the charging rotary member.

Further, according to the above embodiments, the charging rotary member and the image bearing member directly contact with each other, and charging is performed without applying conductive particles between the charging rotary member and the image bearing member. Therefore, simplification can be achieved in its structure.

The present invention is not limited to the above embodiments, and various modifications may be made within the scope of technical concept of the present invention.

What is claimed is:

1. A charging device comprising:

a charging rotary member provided in contact with an image bearing member, which can bear toner, for charging the image bearing member, a peripheral speed of the charging rotary member being different from a peripheral speed of the image bearing member, wherein a rotating direction of the charging rotary member is the same as a rotating direction of the image bearing member in a contact position of the charging rotary member and the image bearing member, and wherein the charging rotary member includes a surface layer frictionally charging the toner to a normal charging polarity of the toner.

2. A charging device according to claim 1, wherein the peripheral speed of the charging rotary member is larger than the peripheral speed of the image bearing member.

3. A charging device according to claim 1, wherein the charging rotary member charges the image bearing member without using conductive particles in a contact position of the charging rotary member and the image bearing member.

4. A charging device according to claim 1, wherein the charging rotary member charges the image bearing member using an electric discharge.

5. A charging device according to claim 1, wherein an electric field in that the toner frictionally charged to the normal polarity is shifted from the charging rotary member to the image bearing member, is formed between the charging rotary member and the image bearing member.

6. A charging device according to claim 5, wherein when the electric field is formed, a voltage changing within a predetermined cycle is applied to the charging rotary member.

7. A charging device according to claim 6, wherein the voltage has a rectangular waveform.

8. A charging device according to any of claims 5 to 7, wherein the electric field is formed with respect to a region, which becomes a non-image formation region of the image bearing member.

9. A charging device according to claim 1, wherein the charging rotary member includes a roller.

10. A charging device according to claim 1, wherein the charging rotary member and the image bearing member are provided in a process cartridge, which is detachably mountable to an image forming apparatus main body.

11. A charging device according to claim 10, wherein the process cartridge includes developing means, which develops an electrostatic image formed on the image bearing member with the toner.

12. A charging device according to claim 11, wherein the developing means can carry out a developing operation while performing a collecting operation for collecting the toner from the image bearing member.

13. An image forming apparatus comprising:

an image bearing member, which can bear toner; and a charging rotary member provided in contact with the image bearing member, for charging the image bearing member, a peripheral speed of the charging rotary member being different from a peripheral speed of the image bearing member, wherein a rotating direction of the charging rotary member is the same as a rotating direction of the image bearing member in a contact position of the charging rotary member and the image bearing member, and wherein the charging rotary member includes a surface layer frictionally charging the toner to a normal charging polarity of the toner.

14. An image forming apparatus according to claim 13, wherein the peripheral speed of the charging rotary member is larger than the peripheral speed of the image bearing member.

15. An image forming apparatus according to claim 13, wherein the charging rotary member charges the image bearing member without using conductive particles in a contact position of the charging rotary member and the image bearing member.

16. An image forming apparatus according to claim 13, wherein the charging rotary member charges the image bearing member using an electric discharge.

17. An image forming apparatus according to claim 13, wherein an electric field in that the toner frictionally charged to the normal polarity is shifted from the charging rotary member to the image bearing member, is formed between the charging rotary member and the image bearing member.

18. An image forming apparatus according to claim 17, wherein when the electric field is formed, a voltage changing within a predetermined cycle is applied to the charging rotary member.

19. An image forming apparatus according to claim 18, wherein the voltage has a rectangular waveform.

20. An image forming apparatus according to any of claims 17 to 19, wherein the electric field is formed with respect to a region, which becomes a non-image formation region of the image bearing member.

21. An image forming apparatus according to claim 13, wherein the charging rotary member includes a roller.

22. An image forming apparatus according to claim 13, wherein the charging rotary member and the image bearing member are provided in a process cartridge, which is detachably mountable to an image forming apparatus main body.

23. An image forming apparatus according to claim 22, further comprising developing means for developing an electrostatic image formed on the image bearing member with the toner.

24. An image forming apparatus according to claim 23, wherein the developing means can carry out a developing operation while performing a collecting operation for collecting the toner from the image bearing member.

25. An image forming apparatus according to claim 23, wherein the developing means develops the electrostatic image with the toner having the same polarity as a charging polarity of the charging rotary member.

* * * * *